US010204590B2

(12) United States Patent
Park

(10) Patent No.: US 10,204,590 B2
(45) Date of Patent: Feb. 12, 2019

(54) PIXEL UNIT, DRIVING METHOD THEREOF, ARRAY SUBSTRATE, AND DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Ku Hyun Park, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 285 days.

(21) Appl. No.: 15/208,785

(22) Filed: Jul. 13, 2016

(65) Prior Publication Data

US 2017/0124978 A1 May 4, 2017

(30) Foreign Application Priority Data

Nov. 4, 2015 (CN) ..... 2015 1 0742478

(51) Int. Cl.
*G09G 3/36* (2006.01)

(52) U.S. Cl.
CPC ..... *G09G 3/3688* (2013.01); *G09G 3/3614* (2013.01); *G09G 3/3659* (2013.01);
(Continued)

(58) Field of Classification Search
CPC ... G09G 2300/0426; G09G 2300/0819; G09G 2320/0247; G09G 3/3614; G09G 3/3688
See application file for complete search history.

(56) References Cited

U.S. PATENT DOCUMENTS

2007/0262938 A1* 11/2007 Kim ..... G02F 1/13624 345/92
2009/0310047 A1* 12/2009 Shin ..... G09G 3/3659 349/37

(Continued)

FOREIGN PATENT DOCUMENTS

CN 1811535 A 8/2006
CN 101071240 A 11/2007
CN 103488017 A 1/2014

OTHER PUBLICATIONS

The First Chinese Office Action dated Mar. 31, 2017; Appln. No. 201510742478.6.

(Continued)

*Primary Examiner* — Viet D Pham
(74) *Attorney, Agent, or Firm* — Ladas & Parry LLP

(57) ABSTRACT

A pixel unit includes: a pixel electrode; a first switching unit, including a first gate electrode, a first source electrode and a first drain electrode which are electrically connected with a gate line, a first data line and the pixel electrode respectively; and a second switching unit, including a second gate electrode, a second source electrode and a second drain electrode which are electrically connected with the gate line, a second data line and the pixel electrode respectively. A difference value between a first jumping voltage and a second jumping voltage is in a range from −0.5 to 0.5 volts, the first jumping voltage is a jumping voltage produced when the first switching unit is changed from an on state to an off state, and the second jumping voltage is a jumping voltage produced when the second switching unit is changed from the on state to the off state.

13 Claims, 5 Drawing Sheets

(52) U.S. Cl.
CPC ..... *G09G 2300/0426* (2013.01); *G09G 2300/0819* (2013.01); *G09G 2320/0219* (2013.01); *G09G 2320/0247* (2013.01)

(56) References Cited

U.S. PATENT DOCUMENTS

| | | | |
|---|---|---|---|
| 2013/0249882 | A1 | 9/2013 | Lin et al. |
| 2014/0362064 | A1 | 12/2014 | Kuo et al. |
| 2015/0109282 | A1 | 4/2015 | Chen et al. |
| 2015/0241740 | A1 | 8/2015 | Yoo et al. |

OTHER PUBLICATIONS

The Second Chinese Office Action dated Dec. 18, 2017; Appln. No. 201510742478.6.

* cited by examiner

PIXEL UNIT, DRIVING METHOD THEREOF, ARRAY SUBSTRATE, AND DISPLAY DEVICE

TECHNICAL FIELD

Embodiments of the present disclosure relate to a pixel unit, a driving method thereof, an array substrate and a display device.

BACKGROUND

With continuous development of display technologies, as illustrated in FIG. 1, a pixel unit 100 in a thin-film transistor liquid crystal display (TFT-LCD) device generally includes a thin-film transistor (TFT), a storage capacitor (Cst) and a pixel electrode configured to apply voltages to liquid crystals.

A signal waveform chart of the above pixel unit is shown in FIG. 2. When a pixel unit structure in related technologies is adopted for display, firstly, a certain high-level voltage Vgh is applied to a gate line of the TFT, so that a source electrode of the TFT is connected to a drain electrode of the TFT and a signal applied on the data line is transferred to a liquid crystal capacitor Clc and the storage capacitor Cst. After one scanning period is completed, the voltage on the gate line is changed into a low-level voltage Vgl. The low-level voltage is usually 0 voltage. At this point, the TFT is on an off state; the liquid crystal capacitor Clc and the storage capacitor Cst maintain the workload; and a jump occurs to the voltage on liquid crystals when ensuring that the TFT is switched off. That is, when ensuring that the TFT is changed from the on state to the off state, a jump occurs to the voltage between both ends of liquid crystals and this jump of the voltage is usually referred to as a jumping voltage (Vp). Generally, ΔVp is calculated according to the following formula:

$$\Delta Vp = (Vgh - Vgl) \times \frac{Cgs}{(Cgs + Clc + Cst)},$$

where Vgh and Vgl respectively refer to a high-level voltage and a low-level voltage applied to the gate line and configured to drive the TFT; and Cgs, Clc and Cst respectively refer to a gate-source capacitance, a liquid crystal capacitance and a storage capacitance of the TFT.

Due to the jumping voltage, the phenomenon of flicker occurs to the display images of the TFT-LCD. Thus, not only the display quality is reduced, but also viewers may suffer from problems such as eye fatigue or even dizziness after long-term viewing.

SUMMARY

Embodiments of the present disclosure provide a pixel unit, a driving method thereof, an array substrate and a display device, which can reduce the phenomenon of flicker in display images of a TFT-LCD caused by jumping voltages and hence improve the display quality.

Embodiments of the present disclosure provide a pixel unit, including: a pixel electrode; a first switching unit, including a first gate electrode, a first source electrode and a first drain electrode, where the first gate electrode, the first source electrode and the first drain electrode of the first switching unit are electrically connected with a gate line, a first data line and the pixel electrode respectively; and a second switching unit, including a second gate electrode, a second source electrode and a second drain electrode, where the second gate electrode, the second source electrode and the second drain electrode of the second switching unit are electrically connected with the gate line, a second data line and the pixel electrode respectively. A difference value between a first jumping voltage and a second jumping voltage is in a range from −0.5 to 0.5 volts, the first jumping voltage is a jumping voltage produced when the first switching unit is changed from an on state to an off state, and the second jumping voltage is a jumping voltage produced when the second switching unit is changed from the on state to the off state.

Embodiments of the present disclosure provide an array substrate, including: a plurality of pixel units having any features described above for the pixel unit, the plurality of pixel units being arranged in an array; and a plurality of gate lines and a plurality of data lines extending across each other. Each pixel unit is connected with one of the plurality of gate lines and two of the plurality of data lines.

Embodiments of the present disclosure provide a display device, including the array substrate described above.

Embodiments of the present disclosure provide a method for driving pixel units being applied in the pixel unit described above. The method includes: inputting a first signal to the gate line, where the first signal is configured to switch on the first switching unit and the second switching unit; inputting a second signal to the first data line, where the second signal is configured to supply power for the pixel electrode through the drain electrode of the first switching unit when the first switching unit is switched on; and inputting a third signal to the second data line, where the third signal is configured to supply power for the pixel electrode through the drain electrode of the second switching unit when the second switching unit is switched on. The pixel unit is driven by a voltage difference value between a driving voltage of the first switching unit and a driving voltage of the second switching unit.

BRIEF DESCRIPTION OF THE DRAWINGS

In order to illustrate the technical solutions in the embodiments of the present disclosure or the existing arts more clearly, the drawings need to be used in the description of the embodiments or the existing arts will be briefly described in the following; it is obvious that the drawings described below are only related to some embodiments of the present disclosure, for one ordinary skilled person in the art, other drawings can be obtained according to these drawings.

REFERENCE NUMERALS OF THE ACCOMPANYING DRAWINGS

1—pixel unit; 10—pixel electrode; 11—first switching unit; 12—gate line; 13—first data line; 14—second switching unit; 15—second data line.

DETAILED DESCRIPTION

Hereafter, the technical solutions of the embodiments of the present disclosure will be described in a clearly and fully understandable way in connection with the drawings related to the embodiments of the disclosure. It is obvious that the described embodiments are just a part but not all of the embodiments of the present disclosure. The drawings mentioned in the embodiments of the present disclosure are only to exemplarily illustrate the technical solutions of the present disclosure. The other drawings obtained from the drawings of the embodiments of the present disclosure through simple transformations should be within the scope of the present disclosure.

Figure 1:
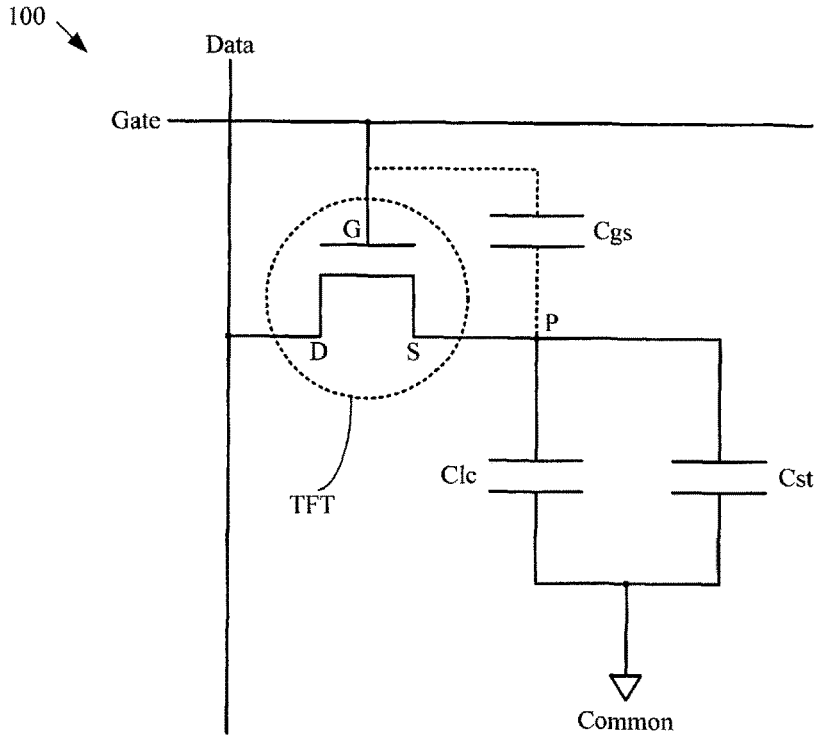
FIG. 1 is an equivalent circuit diagram of a pixel unit in related technologies.
Figure 2:
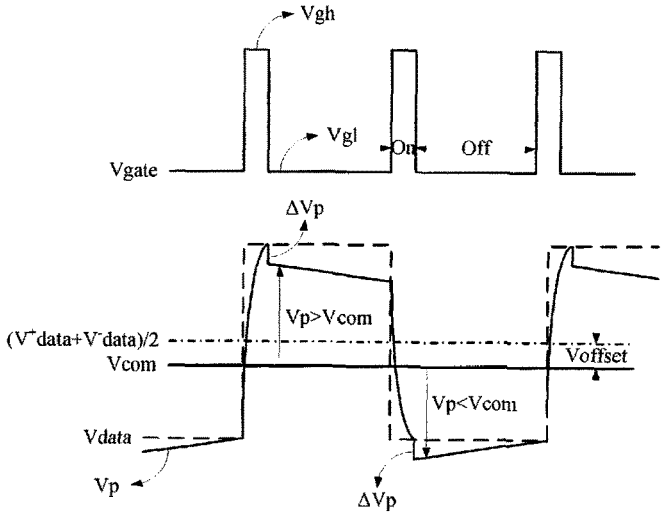
FIG. 2 is a signal waveform diagram of the pixel unit in the related technologies.
Figure 3:
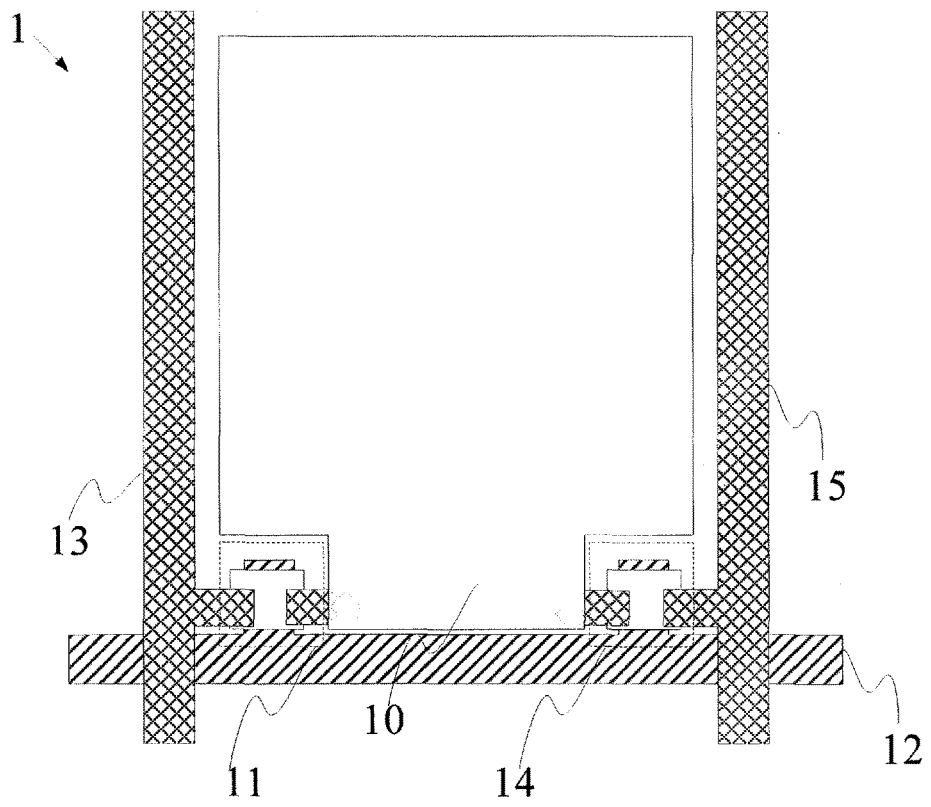
FIG. 3 is a top view of a schematic structure of a pixel unit provided by an embodiment of the present disclosure.

Embodiments of the present disclosure provide a pixel unit 1. A top view of the pixel unit 1 is shown in FIG. 3. The pixel unit 1 includes: a pixel electrode 10; a first switching unit 11 (an element marked by a dashed box in the figure), where a gate electrode, a source electrode and a drain electrode of the first switching unit 11 are electrically connected with a gate line 12, a first data line 13 and the pixel electrode 10 respectively; and a second switching unit 14 (an element marked by a dashed box in the figure), where a gate electrode, a source electrode and a drain electrode of the second switching unit 14 are electrically connected with the gate line 12, a second data line 15 and the pixel electrode 10 respectively. A difference value between a first jumping voltage and a second jumping voltage is within a range of −0.5 volts to 0.5 volts, the first jumping voltage is a jumping voltage produced when the first switching unit 11 is changed from the on state to the off state, and the second jumping voltage is a jumping voltage produced when the second switching unit 14 is changed from the on state to the off state.

For example, the gate electrode, the source electrode and the drain electrode of the first switching unit 11 can be referred to as a first gate electrode, a first source electrode and a first drain electrode, respectively; and the gate electrode, the source electrode and the drain electrode of the second switching unit 14 can be referred to as a second gate electrode, a second source electrode and a second drain electrode, respectively.

Figure 4:
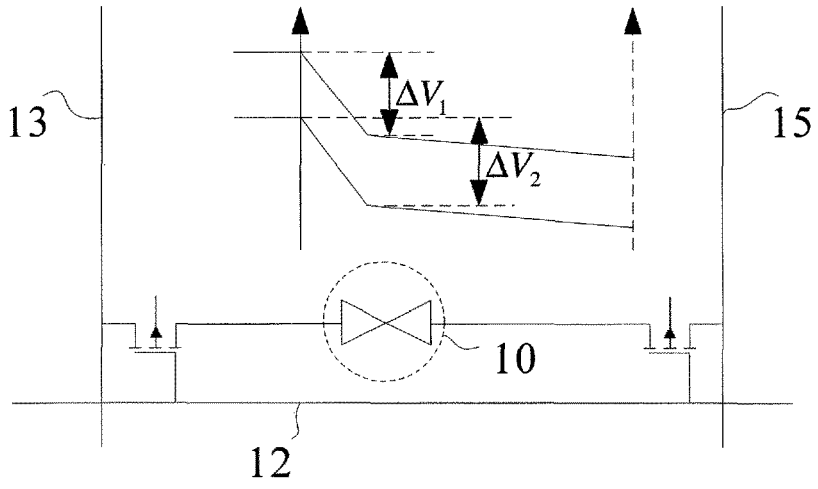
FIG. 4 is an equivalent circuit diagram of a pixel unit provided by an embodiment of the present disclosure.

As illustrated in FIG. 4, a schematic diagram illustrating a circuit structure of the pixel unit provided by an embodiment is shown. For instance, the first jumping voltage $\Delta V_1$ may be calculated according to the following formula (1):

$$\Delta V_1 = \frac{C_{gs1}}{(C_{gs1} + C_{lc} + C_{st})} \times (V_{gh1} - V_{gl1}), \quad \text{formula (1)}$$

where: $C_{gs1}$ refers to a gate-source capacitance of the first switching unit 11; $C_{lc}$ refers to a liquid crystal capacitance; $C_{st}$ refers to a storage capacitance; $V_{gh1}$ refers to a high-level voltage applied to the gate line 12 and configured to drive the first switching unit 11; and $V_{gl1}$ refers to a low-level voltage applied to the gate line 12 and configured to drive the first switching unit 11.

For instance, the second jumping voltage $\Delta V_2$ may be calculated according to the following formula (2):

$$\Delta V_2 = \frac{C_{gs2}}{(C_{gs2} + C_{lc} + C_{st})} \times (V_{gh2} - V_{gl2}), \quad \text{formula (2)}$$

where: $C_{gs2}$ refers to a gate-source capacitance of the second switching unit 14; $C_{lc}$ refers to the liquid crystal capacitance; $C_{st}$ refers to the storage capacitance; $V_{gh2}$ refers to a high-level voltage applied to the gate line 12 and configured to drive the second switching unit 14; and $V_{gl2}$ refers to a low-level voltage applied to the gate line 12 and configured to drive the second switching unit 14.

It should be noted that: in view of simplifying the complexity of the pixel unit structure as much as possible during practical production and application, the first switching unit 11 and the second switching unit 14 may have the same structure type. For example, both of the first switching unit 11 and the second switching unit 14 may be N-type transistors; alternatively, both of the first switching unit 11 and the second switching unit 14 may be P-type transistors.

Similarly, when the first switching unit 11 and the second switching unit 14 are transistors, the first switching unit 11 and the second switching unit 14 may have the same transistor mode; for example, both are TFTs with an enhancement mode (with a threshold voltage being positive), or both are TFTs with a depletion mode (with a threshold voltage being negative).

For instance, the difference between the first jumping voltage and the second jumping voltage is 0.

It should be noted that a scenario when the difference between the first jumping voltage and the second jumping voltage is 0 is an ideal state. When the difference between the first jumping voltage and the second jumping voltage is 0, it indicates that a voltage of the pixel electrode 10 that is connected with both the first switching unit 11 and the second switching unit 14 does not change. Thus, the flicker phenomenon may not occur to the display images in the TFT-LCD, and hence the display quality can be improved.

Moreover, the storage capacitance $C_{st}$ is in a range from 10 fF to 400 fF, where 1 fF=$10^{-15}$ F (Farad).

For instance, the storage capacitance $C_{st}$ is 10 fF.

Moreover, a parasitic capacitance between the source electrode of the first switching unit 11 and the drain electrode of the first switching unit 11 is equal to a parasitic capacitance between the source electrode of the first switching unit 11 and the drain electrode of the second switching unit 14; and a parasitic capacitance between the source electrode of the second switching unit 14 and the drain electrode of the first switching unit 11 is equal to a parasitic capacitance between the source electrode of the second switching unit 14 and the drain electrode of the second switching unit 14.

Figure 5:
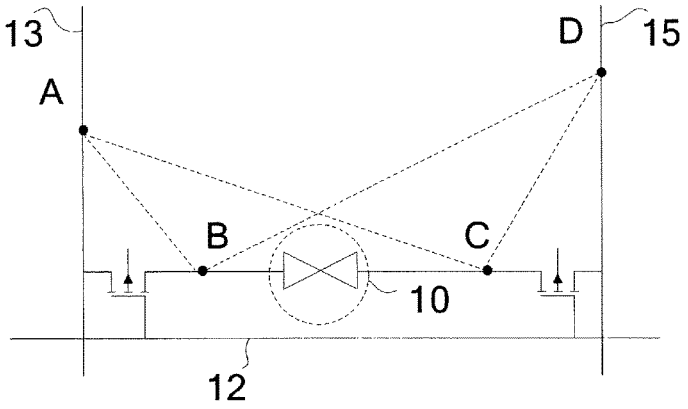
FIG. 5 is an equivalent circuit diagram of another pixel unit provided by an embodiment of the present disclosure.

FIG. 5 is a schematic diagram illustrating a circuit structure of another pixel unit provided by embodiments of the disclosure. A parasitic capacitance C1 between the source electrode of the first switching unit 11 and the drain electrode of the first switching unit 11 (that is, a capacitance between an A point in the figure and a B point in the figure) and a parasitic capacitance C2 between the source electrode of the first switching unit 11 and the drain electrode of the second switching unit 14 (that is, a capacitance between the A point in the figure and a C point in the figure) satisfy C1=C2; and a parasitic capacitance C3 between the source electrode of the second switching unit 14 and the drain electrode of the first switching unit 11 (that is, a capacitance between a D point in the figure and the B point in the figure) and a parasitic capacitance C4 between the source electrode of the second switching unit 14 and the drain electrode of the second switching unit 14 (that is, a capacitance between the D point in the figure and the C point in the figure) satisfy C3=C4. An element marked by a dashed circle in the figure represents an equivalent circuit of the pixel electrode 10 of the pixel unit provided by the embodiment.

Thus, in the ideal state, a variation of the voltage of the pixel electrode connected with both the first switching unit 11 and the second switching unit 14 (that is, a voltage which is actually applied to liquid crystals, thereby causing the flicker phenomenon in display images and affecting the display quality) may be calculated according to the following formulas (3) and (4):

$$C_{lc}(\Delta V_2-\Delta V_1)+C_3(\Delta V_2-\Delta V_{D2})+C_2(\Delta V_2-\Delta V_{D1})=0 \quad (3)$$

$$C_{lc}(\Delta V_1-\Delta V_2)+C_1(\Delta V_1-\Delta V_{D1})+C_4(\Delta V_1-\Delta V_{D2})=0 \quad (4)$$

where $\Delta V_{D1}$ refers to a voltage difference between adjacent signals before being inputted into the first switching unit and after running through the first switching unit; and $\Delta V_{D2}$ refers to a voltage difference between adjacent signals before being inputted into the second switching unit and after running through the second switching unit.

By subtracting the formula (4) from the formula (3) and by C1=C2 and C3=C4, it can be shown that:

$$(2C_{lc}+C_1+C_3)(\Delta V_2-\Delta V_1)=0.$$

Thus, the difference between the first jumping voltage and the second jumping voltage is 0.

The embodiments of the present disclosure provide a pixel unit, which includes: a pixel electrode; a first switching unit, where a gate electrode, a source electrode and a drain electrode of the first switching unit are electrically connected with a gate line, a first data line and the pixel electrode respectively; and a second switching unit, where a gate electrode, a source electrode and a drain electrode of the second switching unit are electrically connected with the gate line, a second data line and the pixel electrode respectively. A difference value between a first jumping voltage and a second jumping voltage is in a range from −0.5 volts to 0.5 volts; the first jumping voltage is a jumping voltage produced when the first switching unit is changed from a switching-on state to a switching-off state; and the second jumping voltage is a jumping voltage produced when the second switching unit is changed from the switching-on state to the switching-off state. On the basis of the description for the above embodiment, as the difference value between the first jumping voltage and the second jumping voltage is in the range from −0.5 volts to 0.5 volts, the influence of the first jumping voltage and the second jumping voltage on the liquid crystals in the display device can be reduced, and hence the flicker phenomenon in the display images of the TFT-LCD can be reduced. Thus, the display quality can be improved.

Figure 6:
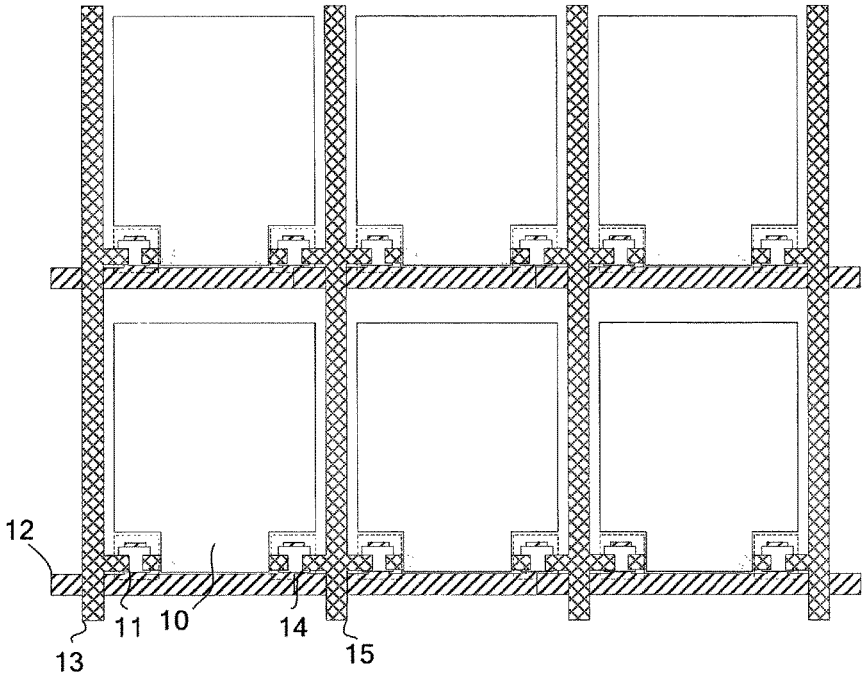
FIG. 6 is a first schematic structural view of an array substrate provided by an embodiment of the present disclosure.

The embodiments of the present disclosure provide an array substrate. As illustrated in FIG. 6, the array substrate includes: a plurality of pixel units being arranged in an array and each having features of any pixel unit described above; and a plurality of gate lines and a plurality of data lines extending across each other (e.g., the gate lines extending across the data lines). For instance, each pixel unit is connected with one gate line and two data lines.

Moreover, the two data lines connected with the same pixel unit are disposed on two sides of the pixel unit, respectively.

Moreover, every two adjacent pixel units arranged along the gate line share one data line disposed between the two adjacent pixel units.

Figure 7:
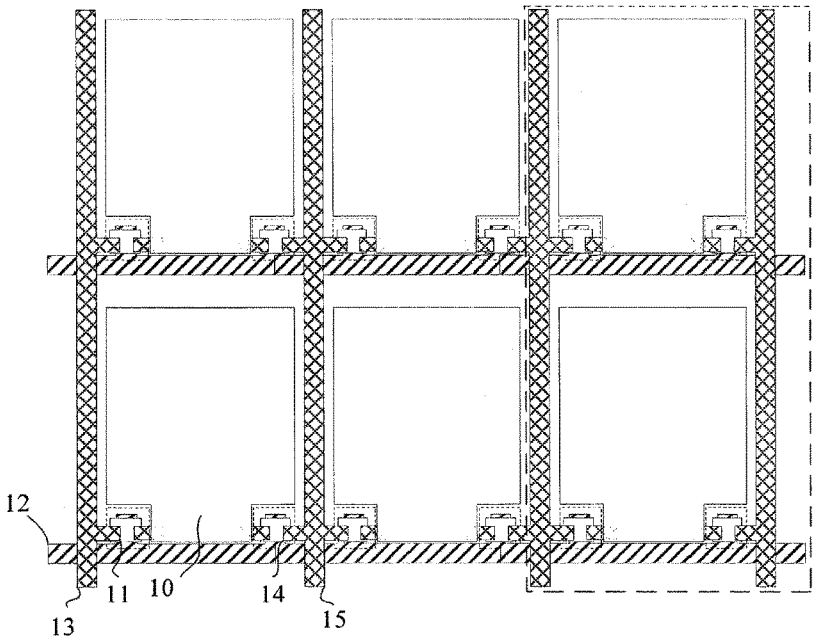
FIG. 7 is a second schematic structural view of an array substrate provided by an embodiment of the present disclosure.

Illustratively, as shown by a portion marked by a dashed box in FIG. 7, if the pixel units are a column of pixel units on the rightmost side of the array substrate, a data line on the right of the pixel units is not shared with other pixel units. Similarly, as shown by a portion marked by a dashed box in FIG. 8, if the pixel units are a column of pixel units on the leftmost side of the array substrate, a data line on the left of the pixel units is not shared with other pixel units.

Figure 8:
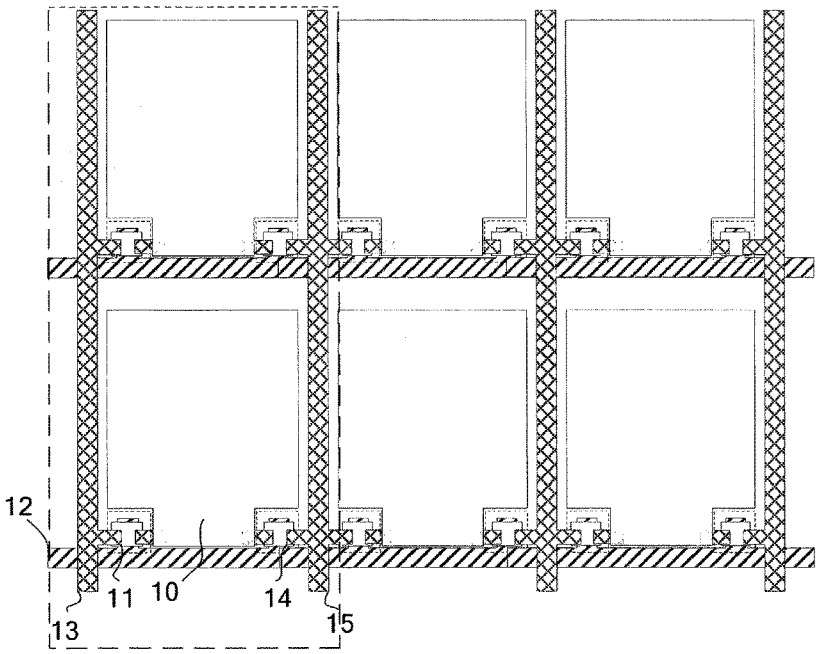
FIG. 8 is a third schematic structural view of an array substrate provided by an embodiment of the present disclosure.

It should be understood that the terms "left" and "right" mentioned in the embodiments of the present disclosure are only used in terms of the orientations as shown in FIGS. 6, 7 and 8, and may be interpreted in specific array substrates according to the actual arrangement of the pixel units. No specific limitation will be given in the present disclosure.

The embodiments of the present disclosure provide an array substrate, which includes: a plurality of pixel units being arranged in an array and each having features of the pixel unit described above, and a plurality of gate lines and data lines extending across each other. Each pixel unit is connected with one gate line and two data lines. On the basis of the description for the above embodiment, as the difference value between the first jumping voltage and the second jumping voltage is in the range from −0.5 to 0.5 volts, the influence of the first jumping voltage and the second jumping voltage on the liquid crystals in the display device can be reduced, and hence the flicker phenomenon in the display images of the TFT-LCD can be reduced. Thus, the display quality can be improved.

The embodiments of the present disclosure provide a method for driving a pixel unit, and can be applied in a pixel unit having any of the features described above. The method for driving the pixel unit includes: inputting a signal to the gate line, where the signal is configured to switch on the first switching unit and the second switching unit; inputting a signal to the first data line, where the signal is configured to supply power for the pixel electrode through the drain electrode of the first switching unit when the first switching unit is switched on; and inputting a signal to the second data line, where the signal is configured to supply power for the pixel electrode through the drain electrode of the second switching unit when the second switching unit is switched on. The pixel unit is driven by a voltage difference value between a driving voltage of the first switching unit and a driving voltage of the second switching unit.

Figure 9:
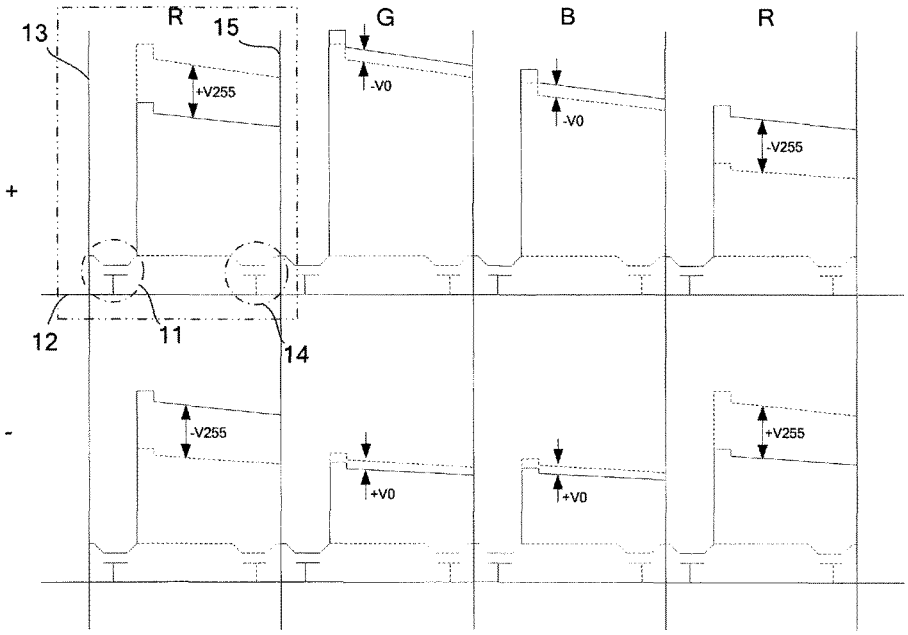
FIG. 9 is a schematic diagram illustrating a polarity inversion of a pixel unit in the case of charging provided by an embodiment of the present disclosure.

As illustrated in FIG. 9, a schematic diagram illustrating a polarity inversion of the pixel unit in the case of charging is shown. Take an R (red) pixel unit marked by a dashed box as an example. A signal is inputted to the gate line 12 and configured to switch on the first switching unit 11 and the second switching unit 14 of the R pixel unit; a signal is inputted to the first data line 13 and configured to supply power for the pixel electrode through the drain electrode of the first switching unit 11 when the first switching unit 11 is switched on; and a signal is inputted to the second data line 15 and configured to supply power for the pixel electrode through the drain electrode of the second switching unit 14 when the second switching unit 14 is switched on. Thus, the R pixel unit is driven by the voltage difference value between the driving voltage of the first switching unit 11 and the driving voltage of the second switching unit 14.

On the basis of the description for the above embodiment, as the difference value between the first jumping voltage and the second jumping voltage is in the range from −0.5 to 0.5 volts, the influence of the first jumping voltage and the second jumping voltage on the liquid crystals in the display device can be reduced. As the actual voltage applied to the liquid crystals is ΔVlc=0, the phenomenon of jitter of liquid crystals caused by the jumping voltages does not occur. Thus, the flicker phenomenon in the display images of the TFT-LCD can be reduced, and hence the display quality can be improved.

The embodiments of the present disclosure provide a display device, which includes an array substrate having any features described above.

It should be noted that, in the drawings, the size of a layer or an area may be exaggerated for clarity of the drawings. Besides, it is understandable that if an element or a layer is said to be "under" another element or layer, it can be directly under the other element or an intermediate layer may exist therebetween. Besides, it is understandable that if a layer or an element is said to be "between" two layers or "between" two elements, it can be the only one layer or element between the two layers or two elements, or one or more intermediate layer or element can exist. Similar reference marks in the full text refer to the similar elements.

Furthermore, the terms 'first,' 'second,' etc., which are used in the description and the claims of the present application for invention, are not intended to indicate any sequence, amount or importance, but distinguish various components or operations. Moreover, the terms "include", "comprise" or its variation are intended to cover non-exclusive inclusion, so that a process, a method, an article or a device including a series of elements not only includes these elements, but also includes other element not explicitly listed, or further includes the element inherent to the process, the method, the article or the device. The element corrected by the words "includes one" or "includes a" does not exclude the inclusion of other same element in the process, the method, the article or the device including the element.

It is noted that the terms 'up,' 'down,' etc., are only used to indicate relative position based on the attached figure in order to make the description easier and simpler, which are not to indicate that a device or an element must be provided, constructed or operated as the specified position, and it should not be interpreted as a limitation to the present invention. Unless otherwise defined, the term 'assemble', 'connected' or 'connection' should be understood in their broad sense, for example, the connection may be a fixed connection, a dismountable connection, or an integrated connection; it can be mechanical connection or electrical connection; it can be direct connection or indirect connection via an intermediate or internal connection of two elements. For those skilled in the art, the specific meaning of these terms in the present invention can be understood according to actual situation.

The foregoing are merely specific embodiments of the disclosure, but not limitative to the protection scope of the disclosure. One skilled in the art could devise variations or replacements that within the scope and the spirit of the present disclosure, those variations or replacements shall belong to the protection scope of the disclosure. Thus, the protection scope of the disclosure shall be defined by the accompanying claims.

The present disclosure claims the benefits of Chinese patent application No. 201510742478.6, which was filed on Nov. 4, 2015 and is incorporated herein in its entirety by reference as part of this application.

What is claimed is:

1. A pixel unit, comprising:

a pixel electrode;

a first switching unit, comprising a first gate electrode, a first source electrode and a first drain electrode, wherein the first gate electrode, the first source electrode and the first drain electrode of the first switching unit are electrically connected with a gate line, a first data line and the pixel electrode respectively;

a second switching unit, comprising a second gate electrode, a second source electrode and a second drain electrode, wherein the second gate electrode, the second source electrode and the second drain electrode of the second switching unit are electrically connected with the gate line, a second data line and the pixel electrode respectively; and wherein a difference value between a first jumping voltage and a second jumping voltage is in a range from −0.5 to 0.5 volts, the first jumping voltage is a jumping voltage produced when the first switching unit is changed from an on state to an off state, and the second jumping voltage is a jumping voltage produced when the second switching unit is changed from the on state to the off state; and a parasitic capacitance between the first source electrode of the first switching unit and the first drain electrode of the first switching unit is equal to a parasitic capacitance between the first source electrode of the first switching unit and the second drain electrode of the second switching unit, and a parasitic capacitance between the second source electrode of the second switching unit and the first drain electrode of the first switching unit is equal to a parasitic capacitance between the second source electrode of the second switching unit and the second drain electrode of the second switching unit.

2. The pixel unit according to claim 1, wherein the first jumping voltage represented by $\Delta V_1$ is:

$$\Delta V_1 = \frac{C_{gs1}}{(C_{gs1} + C_{lc} + C_{st})} \times (V_{gh1} - V_{gl1}),$$

wherein $C_{gs1}$ refers to a gate-source capacitance of the first switching unit, $C_{ic}$ refers to a liquid crystal capacitance, $C_{st}$ refers to a storage capacitance, $V_{gh1}$ refers to a high-level voltage applied to the gate line and configured to drive the first switching unit, and $V_{gl1}$ refers to a low-level voltage applied to the gate line and configured to drive the first switching unit; and wherein the second jumping voltage represented by $\Delta V_2$ is:

$$\Delta V_2 = \frac{C_{gs2}}{(C_{gs2} + C_{lc} + C_{st})} \times (V_{gh2} - V_{gl2}),$$

wherein $C_{gs2}$ refers to a gate-source capacitance of the second switching unit, $C_{ic}$ refers to the liquid crystal capacitance, $C_{st}$ refers to the storage capacitance, $V_{gh2}$ refers to a high-level voltage applied to the gate line and configured to drive the second switching unit, and $V_{gl2}$ refers to a low-level voltage applied to the gate line and configured to drive the second switching unit.

3. The pixel unit according to claim 2, wherein the storage capacitance $C_{st}$ in a range from 10 fF to 400 fF.

4. The pixel unit according to claim 3, wherein the storage capacitance $C_{st}$ is 10 fF.

5. The pixel unit according to claim 2, wherein the difference value between the first jumping voltage and the second jumping voltage is 0.

6. The pixel unit according to claim 2, wherein a parasitic capacitance between the first source electrode of the first switching unit and the first drain electrode of the first switching unit is equal to a parasitic capacitance between the first source electrode of the first switching unit and the second drain electrode of the second switching unit, and a parasitic capacitance between the second source electrode of the second switching unit and the first drain electrode of the first switching unit is equal to a parasitic capacitance between the second source electrode of the second switching unit and the second drain electrode of the second switching unit.

7. The pixel unit according to claim 1, wherein the difference value between the first jumping voltage and the second jumping voltage is 0.

8. An array substrate, comprising:

a plurality of pixel units according to claim 1, the plurality of pixel units being arranged in an array; and a plurality of gate lines and a plurality of data lines extending across each other;

wherein each pixel unit is connected with one of the plurality of gate lines and two of the plurality of data lines.

9. The array substrate according to claim 8, wherein two data lines connected with a same pixel unit are disposed on two sides of the corresponding pixel unit, respectively.

10. The array substrate according to claim 9, wherein every two adjacent pixel units arranged along the gate line share one data line disposed between the two adjacent pixel units.

11. The array substrate according to claim 8, wherein every two adjacent pixel units arranged along a gate line share one data line that is disposed between the two adjacent pixel units.

12. A display device, comprising the array substrate according to claim 8.

13. A method for driving the pixel unit according to claim 1, comprising:

inputting a first signal to the gate line, wherein the first signal is configured to switch on the first switching unit and the second switching unit;

inputting a second signal to the first data line, wherein the second signal is configured to supply power for the pixel electrode through the drain electrode of the first switching unit when the first switching unit is switched on; and inputting a third signal to the second data line, wherein the third signal is configured to supply power for the pixel electrode through the drain electrode of the second switching unit when the second switching unit is switched on;

wherein the pixel unit is driven by a voltage difference value between a driving voltage of the first switching unit and a driving voltage of the second switching unit.

* * * * *